US007569782B2

(12) United States Patent
Martin

(10) Patent No.: US 7,569,782 B2
(45) Date of Patent: Aug. 4, 2009

(54) MULTISTAGE SWITCH

(75) Inventor: Michael Martin, Unsleben (DE)

(73) Assignee: Preh GmbH, Bad Neustadt a.d. Saale ( * ) Notice: Subject to any disclaimer, the term of this patent is extended or adjusted under 35 U.S.C. 154(b) by 0 days.

(21) Appl. No.: 12/014,747

(22) Filed: Jan. 15, 2008

(65) Prior Publication Data

US 2008/0217147 A1 Sep. 11, 2008

Related U.S. Application Data

(63) Continuation of application No. PCT/EP2006/006415, filed on Jul. 1, 2006.

(51) Int. Cl.
*H01H 25/04* (2006.01)

(52) U.S. Cl. ..... 200/6 A

(58) Field of Classification Search ..... 200/4, 200/5 R, 6 A, 17 R, 18, 61.85, 61.27, 61.54, 200/339, 61.88; 341/20, 21, 35; 345/161, 345/184, 156, 157
See application file for complete search history.

(56) References Cited

U.S. PATENT DOCUMENTS

| | | | | |
|---|---|---|---|---|
| 1,612,729 A | | 12/1926 | Johnson | |
| 3,238,316 A | | 3/1966 | Voss | |
| 3,323,386 A | * | 6/1967 | Musick et al. | 74/471 R |
| 3,679,846 A | * | 7/1972 | Dillon et al. | 200/6 A |
| 4,027,119 A | * | 5/1977 | Tezuka | 200/6 A |
| 4,748,441 A | * | 5/1988 | Brzezinski | 345/161 |
| 4,855,704 A | * | 8/1989 | Betz | 336/132 |
| 5,087,904 A | | 2/1992 | DeVolpi | |
| 5,227,594 A | * | 7/1993 | Russo | 200/6 A |
| 5,317,301 A | | 5/1994 | DeVolpi | |
| 5,421,694 A | * | 6/1995 | Baker et al. | 414/694 |
| 5,773,773 A | * | 6/1998 | McCauley et al. | 200/6 A |
| 5,949,404 A | * | 9/1999 | Zabel | 345/161 |
| 5,969,520 A | * | 10/1999 | Schottler | 324/207.2 |
| 6,034,336 A | * | 3/2000 | Lee | 200/18 |
| 6,080,941 A | | 6/2000 | Yokobori | |
| 6,630,635 B1 | * | 10/2003 | Doepner | 200/6 A |

FOREIGN PATENT DOCUMENTS

| | | |
|---|---|---|
| DE | 103 41 602 B3 | 7/2005 |
| GB | 2367431 A | 4/2002 |

* cited by examiner

*Primary Examiner*—Michael A Friedhofer
(74) *Attorney, Agent, or Firm*—Muncy, Geissler, Olds & Lowe, PLLC

(57) ABSTRACT

Conventional operating elements are relatively expensive to manufacture. For this reason, the invention provides an operating element that is easy and economical to manufacture. This is achieved in that an interior formed by the housing is designed in the shape of a spherical segment on whose walls are arranged contacts, and in that a contact carrier is affixed to the lever in such a way that it is supported in the spherical segment.

8 Claims, 1 Drawing Sheet

MULTISTAGE SWITCH

This nonprovisional application is a continuation of International Application No. PCT/EP2006/006415, which was filed on Jul. 1, 2006, and which claims priority to German Patent Application Nos. DE 102005033131 and DE 102005058055, which were filed in Germany on Jul. 15, 2005 and Dec. 6, 2005, respectively, and which are both herein incorporated by reference.

BACKGROUND OF THE INVENTION

1. Field of the Invention

The present invention relates to an operating element for electrical switching.

2. Description of the Background Art

Operating elements, which are designed as joysticks or rocker switches, are used in automobiles, for example, in order to perform electrical switching operations and/or to initiate functions. They are used to operate external rearview mirrors, for example.

From U.S. Pat. No. 6,080,941 is known a rocker switch designed for multiple directions of tilt, which can initiate two-stage switching with each tilt direction. The rocker switch has a housing in which an interior is designed in the form of a spherical segment. Supported within the spherical segment is a part of the rocker that likewise is designed as a spherical segment. Both spherical segments are designed such that the circumference of the spherical segments decreases from the lower section plane of the spherical segments to the upper section plane. Consequently, the rocker must additionally be supported from the bottom. All contacts and contact elements of the rocker switch are arranged on a silicone mat. This prior art rocker switch is expensive to manufacture.

DE 103 41 602 B3 discloses a multifunction switch in which a spherical receptacle is arranged in a mount in the manner of a two-part ball socket. Affixed to the mount are laterally protruding studs that rest loosely on tappet push rods. When the switch is operated, these studs act on switching elements located on a base plate.

SUMMARY OF THE INVENTION

It is therefore an object of the present invention to provide an operating element that is compact and simple in structure as well as economical to manufacture.

An interior formed by the housing is designed in the shape of a spherical segment. The contacts are arranged on the wall of the spherical segment. A contact carrier is affixed to the lever in such a way that it is supported in the spherical segment. In this context, the contacts and contact elements are arranged to correspond to one another in such a way that when the operating element is actuated, at least one contact is closed by the associated contact element. The contacts and associated conductive traces are incorporated in the inner housing wall; this can be accomplished in a simple way in that appropriate metal layers are applied, for example. The contact elements are integrated in the contact carrier. This configuration of the invention has the overall effect that there is no need for any switching elements outside of the housing that would have to be actuated by a mechanism. Only very few individual components need be installed; it is not necessary to additionally support the contact element with the lever. Accordingly, this saves costs and the operating element is very compact.

When the housing is made of two plastics with different galvanic activity, the application of the contacts and conductive traces is greatly simplified. In this context, the places where the contacts and conductive traces are to be applied are made of a material with higher galvanic activity so that they can be suitably etched in preparation for the application. With a simple method of application, the metal layer later adheres only to the etched places.

Injection molding is a customary and simple method.

It is advantageous to implement the contacts on the inside of the housing as a metal grid, since the metal grid can be extrusion-coated with a plastic especially easily by means of a mold.

An additional switch at one operating end of the lever increases the utility of the operating element. In this connection, the switch can be implemented as a rotary switch, rocker switch, or pushbutton, for example.

The operating element is especially well suited for adjusting external rearview mirrors when it is equipped with a switching gate which permits tilting of the lever in four directions.

Producing the housing from two individual parts makes for easier manufacture. In this context, the individual parts are identical in design, for example; this reduces the number of different parts that must be manufactured, which, among others, offers advantages with regard to inventory management. The individual parts may also be different in design, with all contacts and conductive traces preferably being arranged in only one of the two individual parts. This offers the advantage that the other of the individual parts can be produced easily and much more inexpensively out of just one plastic. The individual parts are joined together during assembly of the operating element by such means as gluing, heat-sealing, or interlocking.

Means for securing against relative rotation of the contact carrier and the housing prevent disruption of the function of the operating element by resulting from an angular displacement between the contacts and the associated contact elements.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus, are not limitive of the present invention, and wherein the sole FIGURE illustrates a perspective view of an operating element according to an embodiment of the invention.

DETAILED DESCRIPTION

Figure 1:
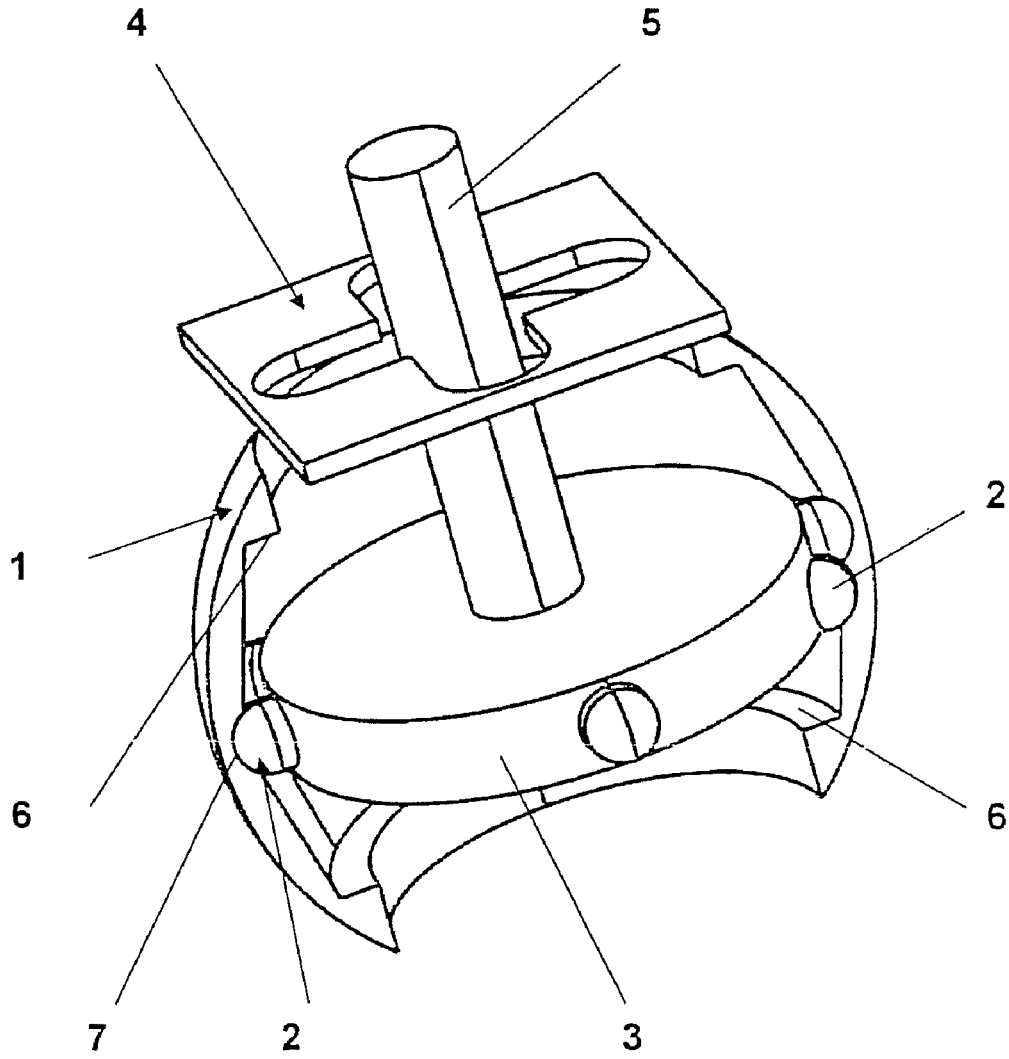

In the following description, position references refer to the representation in the figures. In the installed state, the operating element can have any desired position, in which these position references would then no longer apply.

As is shown in the FIGURE, the operating element includes a housing 1, in which a lever 5 is mounted such that it can tilt.

Both inside and outside, the housing 1 has the form of a hollow spherical segment; in other words, the shape corresponds to a hollow sphere with two spherical caps sliced off by parallel cuts. In this connection, both cuts are the same distance from the center point of the sphere, and the housing 1 is open at the planes formed by the cuts. An inward-facing shoulder 6 over the entire circumference is produced at one lower and one upper edge of the housing 1. The housing 1 can optionally have a different external shape other than a spherical shape.

The housing 1 is manufactured from two individual parts, wherein each of the individual parts is manufactured from two different plastics and the individual parts are identical if desired. A plastic with higher galvanic activity—for example galvanoplastic type ABS—etches well and is used on the places on the inside wall of the housing 1 where the contacts and conductive traces are located in the finished housing 1. The rest of the housing is made of a standard ABS plastic, for example.

Between the housing 1 and an upper operating end (not shown) of the lever 5 a switching gate 4 is located, in which a gate guide permits movement of the lever 5, here in four directions at right angles to one another. In this connection, the switching gate 4 and the housing 1 are fixed relative to one another in that the switching gate is attached to the upper end of the housing 1 in this example embodiment. The center point of the switching gate 4 is located on a straight line through the center points of the plane surfaces of the spherical segment.

A contact carrier 3 is affixed to a lower end of the lever 5 in such a way that the lever 5 stands perpendicular to the carrier's upper principal plane. The contact carrier 3 has the shape of a circular disk whose center point lies in the center point of the housing 1 and whose diameter is dimensioned such that the edges of the contact carrier 3 contact the inner wall of the housing 1, or are spaced only a short distance away from the inner wall. In a neutral position—which is to say, not actuated—of the lever 3, the contact carrier 3 is parallel to the plane surfaces of the housing 1. Four contact elements 2 made of electrically conductive material are arranged at equal distances from one another in the side surface of the contact carrier 3.

In the assembled state of the operating element, the contact elements 2 are located on radial lines that are parallel to and vertically below the gate guide 4. To ensure good contact, the contact elements 2 are elastically mounted on the contact carrier 3. To secure the contact carrier 3 against rotation about the longitudinal axis, it is an option for suitable vertical, circular recesses for guiding the contact elements 2 to be let into the inner wall of the housing 1. To achieve a center detent of the lever 5 in the neutral position, it is an option to let into the housing 1, along a circular path centered between the cut off spherical caps on the inside of the housing 1, recesses 7 corresponding to the contact elements 2, in which all contact elements 2 rest when the operating element is in the non-actuated state.

Contacts that are not shown, and conductive traces connected therewith, are arranged on an inner wall of the housing 1. The contacts form a grid, so that a contact element 2 moves over different contacts located on a vertical, circular path when the lever 5 is tilted, thus producing a multistage operating element. It is an option to recess the contacts in the housing 1, resulting in perceptible detents in the various deflected positions of the lever 5. The switching stages can be established separately for each tilt direction of the lever by the number and/or arrangement of the contacts. It is an option to provide only one stage in one or more of the tilt directions of the lever 5.

The conductive traces can be connected to an electronic control unit by cables or a plug-in contact. By means of this control unit, it is possible to determine the contact where a contact element 2 is located. From this, it is possible to determine the direction and degree of the excursion of the lever 5. In this regard, the contacts correspond to the possible directions of motion of the lever 5 in accordance with the switching gate 4 and are arranged, for example, in the lower half of the housing 1.

An additional switching element may be arranged on the operating end of the lever 5.

The example embodiment relates to an operating element with four directions of motion for the lever 5. The invention also relates to embodiments with a different number of directions of motion, wherein the switching gate 4 and the number of contacts and contact elements 2 must be changed accordingly.

The operating element is manufactured as follows: The individual parts of the housing 1 are molded in a conventional two-component injection molding process, and then etched, with only the galvanoplastic parts being affected. Various metal layers are applied to the affected parts in multiple steps to form the contacts and the conductive traces in a known way. Before the individual parts are joined together, the prefabricated contact carriers 3 with the lever 5 are inserted. Then the switching gate 4 is attached to the housing 1, and the conductive traces are attached to the cables or the plugs.

During operation of the operating element, the lever 5 is moved in the switching gate 4. This causes the contact carrier 3 in the housing 1 to be tilted accordingly, resulting in a stop in that the lever 5 strikes the associated end of the gate guide and/or the contact carrier 3 strikes the shoulders 6. As this occurs, the contact element 2 associated with the direction of motion closes the associated contacts. When the operating element is released, the lever 5, and thus also the contact carrier 3, is returned to the neutral center position by optional elastic elements.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An operating element for electrical switching comprising:

a housing;

a lever mountable in the housing such that it can tilt, the lever being guided within a switching gate; and switching elements having contacts and contact elements, wherein an interior formed by the housing is designed in the shape of a spherical segment on whose walls the contacts are arranged, and wherein a contact carrier is affixed to the lever in such a way that it is supported in the spherical segment.

2. The operating element according to claim 1, wherein the housing is made of two plastics with different galvanic activity.

3. The operating element according to claim 1, wherein the housing is produced with an injection-molding process.

4. The operating element according to claim 1, wherein the contacts located on the inside of the housing are formed by a metal grid.

5. The operating element according to claim 1, wherein an additional switch is arranged on an operating end of the lever.

6. The operating element according to claim 1, wherein the switching gate permits tilting of the lever in four directions.

7. The operating element according to claim 1, wherein the housing is formed from two individual parts.

8. The operating element according to claim 1, wherein a means for securing against rotation are arranged between the contact carrier and the housing.

* * * * *